US008722591B2

(12) United States Patent
Marlin

(10) Patent No.: US 8,722,591 B2
(45) Date of Patent: May 13, 2014

(54) BIODIESEL LIGHTER FLUID

(76) Inventor: Joseph Marlin, Wyalusing, PA (US)

( * ) Notice: Subject to any disclaimer, the term of this patent is extended or adjusted under 35 U.S.C. 154(b) by 84 days.

(21) Appl. No.: 13/092,540

(22) Filed: Apr. 22, 2011

(65) Prior Publication Data

US 2011/0269654 A1 Nov. 3, 2011

Related U.S. Application Data

(60) Provisional application No. 61/328,663, filed on Apr. 28, 2010.

(51) Int. Cl.
*C10M 105/32* (2006.01)
*C10M 105/12* (2006.01)

(52) U.S. Cl.
CPC ..... *C10M 105/12* (2013.01); *C10M 105/32* (2013.01); *C10M 2207/0215* (2013.01); *C10M 2207/2815* (2013.01)
USPC ..... 508/216; 508/583

(58) Field of Classification Search
USPC ..... 508/216, 583
See application file for complete search history.

(56) References Cited

U.S. PATENT DOCUMENTS 5,252,107 A 10/1993 Wilkins, Jr.
5,374,289 A 12/1994 Campana
5,626,636 A 5/1997 Carter
5,713,965 A * 2/1998 Foglia et al. ..... 44/388
2003/0126790 A1* 7/2003 McCoy ..... 44/451
2006/0199988 A1 9/2006 Kowalik
2008/0282606 A1* 11/2008 Plaza et al. ..... 44/308
2011/0008507 A1* 1/2011 Moe et al. ..... 426/523

* cited by examiner

*Primary Examiner* — James Goloboy

(74) *Attorney, Agent, or Firm* — Daniel Boudwin; Global Intellectual Property Agency LLC

(57) ABSTRACT

Disclosed is an environmentally conscious, odor-free lighter fluid mixture comprising a 50-70% ethanol and 30-50% biodiesel combination. Methyl-ester, ethyl-ester and propyl-ester fatty acids, commonly referred to as biodiesel, are clean burning fuels derived from new or waste vegetable oil such as soybean, canola or sunflower. Combined with an ethanol accelerant, the mixture provides a lighter fluid that is easily ignitable without risk of detonation or explosion, and one that brings charcoal briquettes up to temperature quicker than traditional methods. The mixture is petroleum free, which eliminates the associated unpleasant odors and potential health risks of traditional lighter fluid, including a reduction in the emission of volatile organic compounds (VOCs) into the environment. The mixture offers a renewable, sustainable, and efficient ignition source for charcoal that does not sacrifice utility compared to traditional lighter fluid, and does not impart undesirable flavors onto grilled food.

2 Claims, No Drawings

BIODIESEL LIGHTER FLUID

CROSS REFERENCE TO RELATED APPLICATION

This application claims the benefit of U.S. Provisional Application No. 61/328,663 filed on Apr. 28, 2010, entitled "Bio Lighter."

BACKGROUND OF THE INVENTION

1. Field of the Invention

The present invention relates to a charcoal lighter fluid compound. More specifically, the present invention relates to a biodiesel/accelerant mixture that provides an environmentally friendly lighter fluid that does not produce noxious odors or large quantities of volatile organic compounds in proximity to food preparation areas.

2. Description of the Prior Art

A popular warm weather activity is grilling food outdoors. Common methods for creating a heat source to prepare food on a grill includes gas, charcoal, electric heat or wood pellets. Use of charcoal often requires a secondary ignition agent for igniting its slow burning composition and bringing it up to temperature prior to cooking food. Lighter fluid, an aliphatic petroleum solvent, is a common choice of ignition agent, which is a low flashpoint mixture that is very useful for initiating and maintaining a flame over charcoal.

Use of traditional lighter fluid is not without its drawbacks. Charcoal lighter fluids emit volatile organic compounds (VOCs) into the atmosphere through evaporation and through the burning of fluid soaked charcoal. VOCs are harmful toxins that contribute to the formation of ground-level ozone when mixed with other pollutants in sunlight, which can cause serious short-term and long-term health problems. The high vapor pressure of most VOCs means that these compounds are easily evaporative and rapidly enter the atmosphere when sprayed over charcoal.

In 1990, the EPA released a study stating that lighter fluid releases a considerable amount of Volatile Organic Compounds (VOCs) into the air. In the study, the EPA estimated that 14,500 tons of VOCs are released annually in the U.S. from charcoal lighter fluid alone, with an environmental impact equivalent to the hydrocarbon emissions from 375,000 passenger cars. Areas such as southern California have imposed tighter regulations on charcoal lighter fluids and Kansas City has held events to discourage their use. Many local governments are legally implementing a change from lighter fluids to cleaner alternatives, while many companies have created alternative products to preemptively solve these concerns involving lighter fluid use and VOCs emissions.

The use of traditional lighter fluid in proximity to consumable food is a public health concern and a controversial topic, as the fluid is petroleum based and highly carcinogenic. When cooking food using charcoal briquettes soaked in lighter fluid, a risk of leaving a residue of toxic chemicals on food is introduced. The lighter fluid eventually burns off from the charcoal, but this may take upwards of 30 minutes to ash the charcoal and burn off all petroleum emissions in order to avoid leaving a foul taste and odor on food. If adequate time is not provided to burn the lighter fluid from the charcoal, the aroma of lighter fluid is often noticeable to consumers from an olfactory and taste perspective.

Therefore a need arises in the art for an alternative lighter fluid mixture, one that takes the place of traditional lighter fluid compounds, one in which does not introduce potentially harmful byproducts into a food preparation area, and one that is environmentally conscious. The alternative fluid must contain a compound with an adequate flash point such that ignition is easily achieved, and one that can generate the required heat and burn time required to ignite solid carbonaceous and wood fuels.

Several compounds and devices have been disclosed in the prior art for lighting charcoal using alternative means. U.S. Pat. No. 5,252,107 to Wilkins, Jr. discloses an environmentally safe fluid for the ignition of charcoals, comprising liquid terpenes and mixtures thereof. While this patent provides an environmentally conscious alternative to traditional lighter fluid, no mention is made of utilizing biodiesel combined in a mixture with an accelerant to provide adequate lighting fluid over charcoal.

U.S. Published Patent Application, Publication No. 2011/0008507 to Moe describes a biodiesel/n-butanol lighter fluid mixture that is an alternative to traditional lighter fluid compositions. The Moe disclosure utilizes this alternative compound to light charcoal, without the drawbacks of traditional lighter fluid emissions and VOCs. However, the mixture does not make reference to the use of ethanol in any combination with methyl-ester, ethyl-ester or propyl-ester fatty acid biodiesel. In this manner, the present invention diverges in composition from the Wilkins, Jr. and Moe patents.

Devices disclosed in the prior art for lighting firewood and charcoal include U.S. Pat. No. 5,626,636 to Carter and U.S. Pat. No. 5,374,289 Campana. The Carter patent describes a combustible bag having an inner and outer liner for igniting charcoal while the Campana patent describes a cardboard igniting container that does not include petroleum distillates for igniting charcoal. Both of these patents are useful for lighting charcoal without using a petroleum-based lighter fluid, but both fail to provide an igniting fluid alternative that provides the same capabilities as lighter fluid without its drawbacks, as the present invention discloses.

In this regard, the present invention provides a new and unique lighter fluid mixture for the purposes of igniting charcoal. The disclosed mixture is not petroleum based, is a renewable, eco-friendly alternative, and does not introduce the extent of unburned hydrocarbons or volatile organic compounds into the atmosphere and around consumable food products. The present invention is derived from a renewable and sustainable source of energy, and is therefore more environmentally responsible, while still maintaining at least equivalent utility with respect to traditional lighter fluid when igniting charcoal briquettes.

SUMMARY OF THE INVENTION

In view of the foregoing disadvantages inherent in the known types of environmentally conscious lighter fluid mixtures now present in the prior art, the present invention provides a new lighter fluid comprising a unique bi-fuel formula wherein the same can be utilized for providing convenience for the user when lighting solid fuels such as charcoal briquettes, wood pellets and firewood.

It is therefore an object of the present invention to provide an environmentally friendly, non-petroleum based lighter fluid mixture that utilizes a renewable energy source.

Another object of the present invention is to provide a bi-fuel lighter fluid comprising a biodiesel/accelerant mixture that is of adequate flash point and fire point to be easily ignited and maintain a high burn temperature after ignition to ash charcoal and ignite firewood.

Another object of the present invention is to provide a lighter fluid that ashes charcoal quicker than traditional lighter fluid, while not emitting the high levels of toxic byproducts into the environment in the process, particularly in close proximity to food products.

Yet another object of the present invention is to provide a lighter fluid mixture of accelerant and methyl-ester, ethyl-ester or propyl-ester fatty acids wherein the accelerant may comprise ethanol, methanol, isopropanol, butanol, or denatured alcohol.

Yet another object of the present invention is to provide a lighter fluid mixture comprising a 50-70% accelerant and 30-50% biodiesel combination.

A final object of the present invention is to provide biodiesel/ethanol mixtures of various percentages suitable for several purposes, particularly as a kerosene substitute.

Other objects, features and advantages of the present invention will become apparent from the following detailed description taken in conjunction with the accompanying drawings.

DETAILED DESCRIPTION OF THE INVENTION

The present invention is a biodiesel/accelerant mixture for use in lighting charcoal briquettes, firewood or wood pellets. The mixture is especially useful for charcoal grilling food, because of the low emissions related to its composition and vegetable oil scent while burning. Methyl-ester, ethyl-ester and propyl-ester fatty acids, or biodiesel, are clean burning fuels made through a chemical process of transesterification, whereby glycerin is separated from fat or vegetable oil (triglycerides). When burned, the fuel emits a fried food or barbeque aroma, along with fewer noxious emissions than most fuels while being derived from a renewable, sustainable resource.

Biodiesel, when combined with an accelerant such as alcohol, can produce a flammable mixture that is useful for igniting a solid fuel and initiating its burn. The preferred embodiment of the present invention is a mixture of biodiesel and ethanol in a 30% biodiesel/70% ethanol combination. In the mixture percentage, the present invention provides an ideal lighter fluid supplement, wherein the petroleum free mixture is useful for supplying a fast and efficient means of lighting charcoal without the associated odors of traditional lighter fluid compounds and without the high level of toxic emissions.

Alternative embodiments of the mixture include use of different accelerant types in combination with biodiesel, including methanol, isopropanol, butanol, or denatured alcohol, as well as different percentage mixtures of biodiesel and accelerant. Alternative levels of biodiesel (methyl-ester, ethyl-ester and propyl-ester fatty acids) and ethanol comprise a mixture ranging from 50-70% ethanol and 30-50% biodiesel. It has been shown for ease of manufacturing and production, a 1:2 biodiesel to ethanol ratio works nearly identical to the preferred embodiment of the mixture. The ethanol and biodiesel may be derived from any number of sources, including renewable products such as corn, soybeans and other plant based biodiesel/ethanol sources.

Through physical testing it has been shown that the preferred mixture of biodiesel and ethanol creates a flammable lighter fluid that heats charcoal to the appropriate temperature 33% faster than traditional lighter fluids with the same charcoal. The present mixture provides for faster preparation of a grill prior to cooking food, and does not introduce the levels of VOCs and other pollutants that are prevalent with traditional lighter fluids. The smell from the present invention is similar to a food smell as it is burned, rather than a noxious odor that is potentially harmful to one's health and transferrable to the food while on the grill.

The environmental advantages of the preferred mixture are primarily that it burns much cleaner than its aliphatic petroleum solvent-based lighter fluid counterpart, such as those commercially available in supermarkets. Table 1 highlights the comparison in emissions between the present invention and a traditional lighter fluid.

TABLE 1

Reduction in Emissions between 30/70 Biodiesel/Ethanol and Aliphatic Petroleum Solvent-based Lighter Fluid

| | |
|---|---|
| Total Unburned Hydrocarbons | −67% |
| Carbon Monoxide | −48% |
| Particulate Matter | −47% |
| Sulfates | −100% |
| PAH (Polycyclic Aromatic Hydrocarbons) | −80% |
| nPAH (nitrated PAH's) | −90% |
| Ozone potential of speciated HC | −50% |

Although the preferred embodiment of the present invention includes ethanol, it is not intended to limit the accelerant type to just this compound. Any number of alternatives may be substituted by one skilled in the art to provide the same ignition capability, including replacement in favor of methanol, isopropanol, butanol, or denatured alcohol.

In use, the preferred embodiment of the disclosed mixture is an eco-friendly fluid comprised of renewable compounds, and one that reduces the harmful byproducts that are associated with its combustion as compared to current lighter fluids. The mixture is useful as an ignition agent in a plurality of situations and with several types of solid fuel, including charcoal briquettes, firewood or wood pellets. Typical environments for its use include a grill, campfire, stove or oven setting. Its composition is derived from renewable compounds, which does not require a user to sacrifice utility for the sake of environmental considerations. The preferred mixture has been shown to exceed current lighter fluid capabilities by reducing the preparation time of burning charcoal, while providing so with reduced emissions and reduced fumes in proximity to consumable food.

Table 2 below shows the preferred embodiment's physical data.

TABLE 2

30/70 Biodiesel/Ethanol Physical Data

| | |
|---|---|
| Appearance: | Clear Amber Liquid |
| Odor: | Mild Aromatic |
| Boiling Range: | 75 76 100* C./167 169 212* F. |
| Auto Ignition Temperature: | 343 C./650 F. (Lowest Component) |
| Lower Flammable Limit in Air (% by vole): | 2.2 (Lowest Component) |
| Flash Point (Test Method): | 12 C./54 F. (TCC) |
| Flammability Classification: | Class I B |
| API: | 36.2 |
| Specific Gravity (Water = 1): | 0.844 |
| Pounds/Gallon: | 7.027 |
| VOC'S (>0.44 Lbs/Sq In): | 74.5 Vol. %/628.1 g/L/5.232 Lbs/Gal |
| Total VOC'S (TVOC): | 79.0 Vol. %/628.2 g/L/5.232 Lbs/Gal |
| Nonexempt VOC'S (CVOC): | 79.0 Vol. %/628.2 g/L/5.232 Lbs/Gal |
| Hazardous Air Pollutants (HAPS): | 1 Wt. %/.8 g/L/6.903 Lbs/Gal |
| Vapor Pressure (mm of Hg)@20 C. | 33.7 |
| Nonexempt VOC Partial Pressure (mm of Hg @ 20 C.) | 26.9 |
| Vapor Density (air = 1): | 1.2 |
| Water Absorption: | Appreciable |
| Refractive Index: | 1.358 |

(* = End Point)

Additional utility of the biodiesel and ethanol mixture revolves around its modularity. Along with a providing an eco-friendly lighter fluid for lighting solid fuels, the present invention may be utilized in several other functions. The mixture lends itself readily as a kerosene substitute for nearly every application of kerosene, including: penetrating oil, lubricant, fuel additive, poi fuel, adhesive solvent, controlled burn fuel, heating oil and vehicle fuel. For a fuel additive, the mixture adds lubricity to low-sulfur fuels and lowers the 'gel' point of diesel fuels. It is not desired to limit the disclosed invention to a single purpose, but alternatively to disclose a biodiesel/accelerant mixture that can be contemplated for several functions.

For these uses, the mixture ratio may be altered to change the properties of the composition depending on its intended purpose. The following table recites specific examples of the mixture as a kerosene replacement and corresponding mixture percentages of ethanol to Biodiesel for those purposes.

TABLE 3

| Preferred Ethanol/Biodiesel Percentages for Alternative Purposes | |
|---|---|
| Penetrating Oil | 30/70 |
| Lubricant | 10/90 |
| Fuel Additive | 20/80 |
| Adhesive Solvent | 40/60 |
| Heating Oil | 14/86 |

It is therefore intended that the proposed combination of biodiesel and ethanol provide users with a wide variety of functions and uses, depending on the mixture ratio. As noted, these alternate mixture ratios provide for a ready replacement for kerosene, while the preferred embodiment of the mixture is a ready replacement for current lighter fluids. The disclosed mixture provides all of the utility of its petroleum based counterparts, but it is not derived from fossil fuels. This point adds to the utility of the mixture, as it may be used as a replacement for traditional, petroleum based compounds that are limited in their long-term availability.

It is therefore realized that the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A kerosene replacement, consisting of a biodiesel and ethanol mixture, wherein said mixture is between 70 and 90 percent ethyl-ester fatty acid derived biodiesel by volume, and between 10 and 30 percent ethanol by volume, and is suitable for use as penetrating oil.

2. A composition as in claim 1, wherein said mixture is 70% ethyl-ester fatty acid derived biodiesel and 30% ethanol by volume, and is suitable for use as penetrating oil.

* * * * *